United States Patent [19]

Masaki et al.

[11] 4,385,612

[45] May 31, 1983

[54] AIR-FUEL RATIO CONTROL SYSTEM FOR INTERNAL COMBUSTION ENGINES

[75] Inventors: Kenji Masaki; Hidetoshi Kanegae, both of Yokohama, Japan

[73] Assignee: Nissan Motor Company, Limited, Kanagawa, Japan

[21] Appl. No.: 136,753

[22] Filed: Apr. 3, 1980

[30] Foreign Application Priority Data

Apr. 6, 1979 [JP] Japan ..... 54-40877

[51] Int. Cl.[3] ..... F02D 5/00

[52] U.S. Cl. ..... 123/489; 123/440

[58] Field of Search ..... 123/440, 489, 589; 60/276, 285

[56] References Cited

U.S. PATENT DOCUMENTS

| | | | |
|---|---|---|---|
| 4,073,269 | 2/1978 | Herth et al. | 123/489 |
| 4,111,162 | 9/1978 | Norimatsu et al. | 123/440 |
| 4,112,880 | 9/1978 | Asano et al. | 123/440 |
| 4,140,086 | 2/1979 | Schnurle et al. | 123/440 |
| 4,210,106 | 7/1980 | Wessel et al. | 123/489 |
| 4,228,775 | 10/1980 | Schweikert | 123/489 |

FOREIGN PATENT DOCUMENTS

| | | |
|---|---|---|
| 2010793 | 10/1970 | Fed. Rep. of Germany . |
| 2448306 | 4/1976 | Fed. Rep. of Germany . |
| 2658613 | 7/1977 | Fed. Rep. of Germany . |

*Primary Examiner*—Charles J. Myhre
*Assistant Examiner*—Andrew M. Dolinar
*Attorney, Agent, or Firm*—Lowe, King, Price & Becker

[57] ABSTRACT

An air-fuel ratio control system is disclosed for controlling the air-fuel ratio of a mixture supplied to an engine on one side of stoichiometric. The system comprises a sensor for detecting the arrival of the inlet air-fuel ratio at its stoichiometric level and fuel supply means for supplying a controlled amount of fuel to the intake system of the engine. Control means is associated with the sensor for providing first and second control signals to the fuel supply means so as to control the amount of fuel supplied therethrough. The first control signal occurs to cause the inlet air-fuel ratio to vary toward the stoichiometric level and the second signal occurs for a predetermined period of time after the inlet air-fuel ratio arrives at the stoichiometric level to cause the inlet air-fuel ratio to vary away from the stoichiometric level.

4 Claims, 8 Drawing Figures

AIR-FUEL RATIO CONTROL SYSTEM FOR INTERNAL COMBUSTION ENGINES

BACKGROUND OF THE INVENTION

1. Field of the Invention

This invention relates to an air-fuel ratio control system for use in an internal combustion engine and, more particularly, to such an air-fuel ratio control system for controlling the intake air-fuel ratio on the rich or lean side of stoichiometric.

2. Description of the Prior Art

Air-fuel ratio control systems have already been proposed which include an exhaust gas sensor such as an oxygen sensor provided in the exhaust passage of an engine. Such an oxygen sensor is responsive to the concentration of the residual oxygen of exhaust gases flowing thereover for providing an on-off type of signal around stoichiometric air-fuel conditions. The output signal of the oxygen sensor is used for feedback control of the amount of fuel supplied to the engine so as to maintain the inlet air-fuel ratio around the stoichiometric conditions.

Although such conventional air-fuel ratio control systems are convenient to be used with a three-way catalyzer having oxidation and reduction functions for totally purifying exhaust emissions, it is extremely difficult to control the inlet air-fuel ratio on the lean side of stoichiometric, for example, around 17 for higher fuel economy or on the rich side of stoichiometric, for example, around 13 for higher engine output.

This is, such an exhaust gas sensor such as a zirconia oxygen sensor, having its output sharply changed between its on and off states around stoichiometric air-fuel conditions and held substantially constant except around stoichiometric air-fuel conditions, cannot be used directly for controlling the inlet air-fuel ratio except around stoichiometric air-fuel conditions and cannot be used for controlling the inlet air-fuel ratio with great accuracy and without spoiling the performance of an engine equipped with an exhaust emission purifying system such as an exhaust gas recirculation system.

SUMMARY OF THE INVENTION

It is therefore one object of the present invention to provide an air-fuel ratio control system which can control the inlet air-fuel ratio on rich or lean side of stoichiometric with the use of a conventional exhaust gas sensor having its output sharply changed around stoichiometric air-fuel conditions.

Another object of the present invention is to provide an air-fuel ratio control system which is relatively simple in structure.

Still another object of the present invention is to provide an air-fuel ratio control system which can eliminate the need for any highly accurate and expensive fuel supply system, resulting in cost reduction.

According to the present invention, these and other object are accomplished by an air-fuel ratio control system for use in an internal combustion engine, which comprises a sensor provided in the exhaust passage of the engine for detecting the arrival of the air-fuel ratio of a mixture supplied to the engine at its stoichiometric level in response to the concentration of one ingredient of exhaust gases flowing thereover, fuel supply means for supplying a controlled amount of fuel into the intake system of the engine, control means associated with the sensor for providing first and second control signals to the fuel supply means so as to control the amount of fuel supplied therethrough, the first control signal occurring for a predetermined period of time after the inlet air-fuel ratio arrives at the stoichiometric level to cause the inlet air-fuel ratio to vary away from the stoichiometric level and the second control signal occurring with the lapse of the predetermined period of time to cause the inlet air-fuel ratio to vary toward the stoichiometric level, thereby controlling the average inlet air-fuel ratio on one side of stoichiometric.

Other objects, means, and advantages of the present invention will become apparent to one skilled in the art thereof from the following description.

DESCRIPTION OF THE PREFERRED EMBODIMENTS

Figure 1:
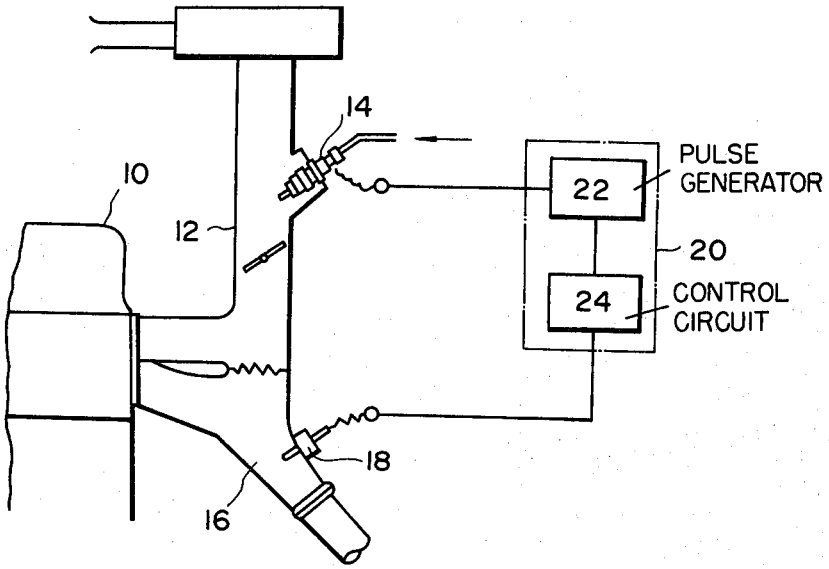
FIG. 1 is a schematic view showing an internal combustion engine equipped with an air-fuel ratio control system made in accordance with the present invention.

Referring now to FIG. 1, there is illustrated an internal combustion engine 10 which includes an intake passage 12 fitted with an electronic controlled fuel injection valve 14, and an exhaust passage 16 provided with an exhaust gas sensor 18 such as a zirconia oxygen sensor responsive to the concentration of the residual oxygen of exhaust gases flowing thereover for having its output sharply changed between its on and off states around stoichiometric air-fuel conditions. The exhaust gas sensor may be of another type which is responsive to the concentration of one ingredient of exhaust gases for having its output state sharply changed around stoichiometric air-fuel conditions. The output of the zirconia oxygen sensor 18 is connected to an electronic control unit 20 which includes a pulse generator 22 for providing drive pulses to the fuel injection valve 14 to control it, and a control circuit 24 responsive to the output of the zirconia oxygen sensor 18 for providing a control signal to the pulse generator 22. The air-fuel ratio control system of the present invention is also applicable to an engine equipped with a carburetor, instead of the fuel injection valve 14.

Figure 2:
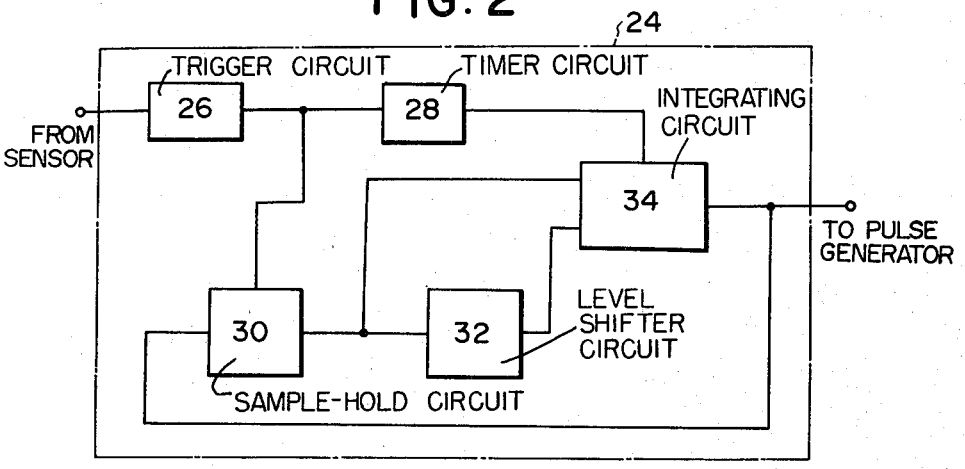
FIG. 2 is a block diagram showing the significant portion of the air-fuel ratio control system of FIG. 1.

Referring to FIG. 2, the control circuit 24 comprises a Schmitt trigger 26 having an input from the zirconia oxygen sensor 18 for providing a trigger pulse of predetermined pulse width each time the output of the zirconia oxygen sensor 18 changes between its high and low states. In this case, the zirconia oxygen sensor 18 is designed such as to have its output going low at the time when the inlet air-fuel ratio shifts from the rich side to the lean side of stoichiometric. The output of the trigger circuit 26 is connected to the input of a timer circuit 28 which has its output set at its low level in synchronism with the leading edge of the trigger pulse applied thereto from the trigger circuit 26, held low for a predetermined period of time t of, for example, several seconds, and then automatically returned to its high level.

The control circuit 24 also comprises a sample-hold circuit 30, a level shifter circuit 32, and an integrating circuit 34 having inputs from the timer circuit 28, the sample-hold circuit 30 and the level shifter circuit 32. The integrating circuit 34 is reset to generate at its output a signal that is the same in level as the output of the level shifter circuit 32 when the timer circuit 28 provides a low output thereto. The integrating circuit 34 is responsive to a high input from the timer circuit 28 for integrating the output of the sample-hold circuit 30 relative to the output of the level shifter circuit 32. The sample-hold circuit 30 has input from the trigger circuit 26 and the integrating circuit 34 for sampling the output of the integrating circuit 34 in response to a high input from the trigger circuit 26 and for holding the output of the integrating circuit 34 in response to a low input from the trigger circuit 26. The output of the sample-hold circuit 30 is coupled to the level shifter circuit 32 where it is shifted up or down by a constant level.

Assuming first that the level shifter circuit 32 is designed such as to shift the output of the sample-hold circuit 30 up by a constant level, the operation of the air-fuel ratio control system of the present invention will now be described with reference to the wave forms of FIG. 3.

Figure 3:
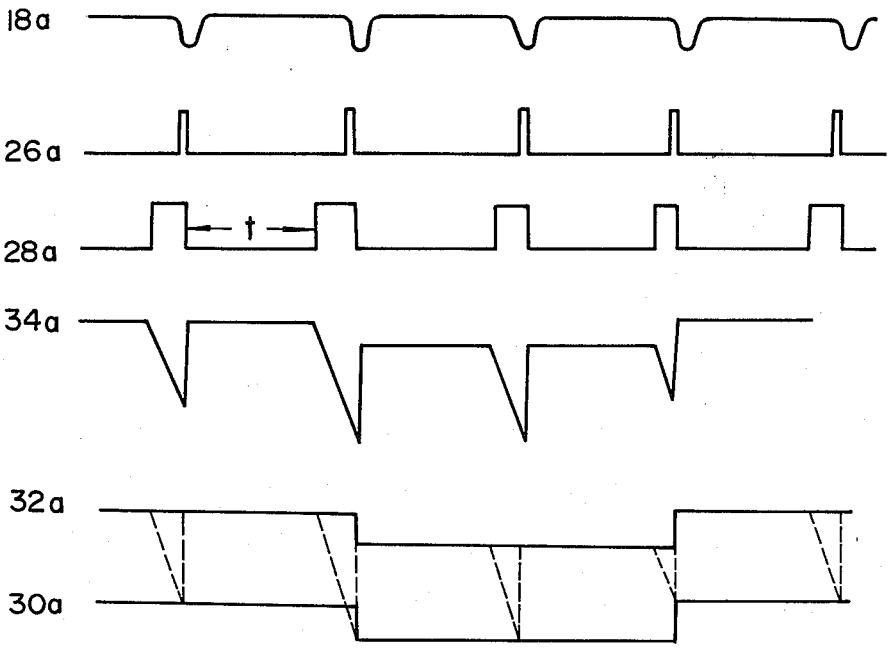
FIG. 3 shows a plurality of wave forms representing the outputs of various elements in the circuit of FIG. 2.

If the inlet air-fuel ratio shifts toward the lean side of stoichiometric and arrives at its stoichiometric level, the output of the zirconia oxygen sensor 18 becomes low as seen in wave form 18*a* of FIG. 3 to cause the trigger circuit 26 to produce a trigger pulse as seen in wave form 26*a* of FIG. 3. As a result, the sample-hold circuit 30 samples the output of the integrating circuit 34. At the same time when the output of the trigger circuit 26 becomes low, the timer circuit 28 is reset at its low level. The output of the timer circuit 28 is held low for a predetermined period of time t, as seen in wave form 28*a* of FIG. 3, to hold the integrating circuit 34 reset during the period of time t. As a result, the output of the integrating circuit 34 is held equal to the output of the level shifter circuit 32. The level shifter circuit 32 shifts the output of the sample-hold circuit 30 up by a constant level as seen in wave forms 30*a* and 32*a* of FIG. 3. The output of the integrating circuit 34 is applied as a first control signal to the pulse generator 22 which provides a drive pulse signal to the fuel injection valve 14 to control it such that the amount of fuel injected through the fuel injection valve 14 increases to enrich the inlet air-fuel ratio. This condition continues for the period of time t predetermined in the timer circuit 28.

When the output of the timer circuit 28 goes high automatically with the lapse of the predetermined period of time t after it is reset as seen in wave form 28*a* of FIG. 3, the integrating circuit 34 starts integrating the output of the sample-hold circuit 30 relative to the output of the level shifter circuit 32. The integrating circuit 34 ramps downward at a constant rate as seen in wave form 34*a* of FIG. 3 since the difference in level between the outputs of the sample-hold circuit 30 and the level shifter circuit 32 is constant as heretofore stated. The output of the integrating circuit 34 is applied as a second control signal to the pulse generator 22 which provides a drive pulse signal to the fuel injection valve 14 to control it such that the amount of fuel injected through the fuel injection valve 14 decreases to rarefy the inlet air-fuel ratio as the output of the integrating circuit 34 ramps downward. This condition continues until the inlet air-fuel ratio is rarefied to the stoichiometric level.

When the inlet air-fuel ratio is rarefied to the stoichiometric level, the output of the zirconia oxygen sensor 18 goes low and the above operation is repeated.

Figure 4:
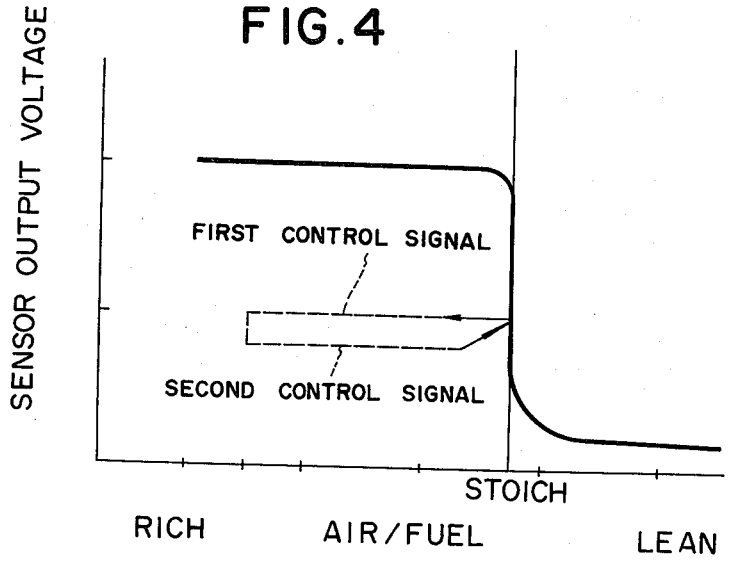
FIG. 4 shows variations in the inlet air-fuel ratio provided by the system of the present invention.

FIG. 4 illustrates variations in the inlet air-fuel ratio provided by the air-fuel ratio control system. The zirconia oxygen sensor 18 having its output sharply changed around stoichiometric air-fuel conditions is utilized as a lean side limiter for detecting the inlet air-fuel ratio rarefied to its stoichiometric level. The control system controls the fuel injection valves 14 such that the amount of fuel injected therethrough increases to enrich the inlet air-fuel ratio for a predetermined period of time after the inlet air-fuel ratio is rarefied to the stoichiometric level and then it decreases to rarefy the inlet air-fuel ratio until the inlet air-fuel ratio is rarefied to the stoichiometric level. This operation is repeated so that the average inlet air-fuel ratio can be held at a desired level or in a desired range on the rich side of stoichiometric as shown in FIG. 5.

Figure 5:
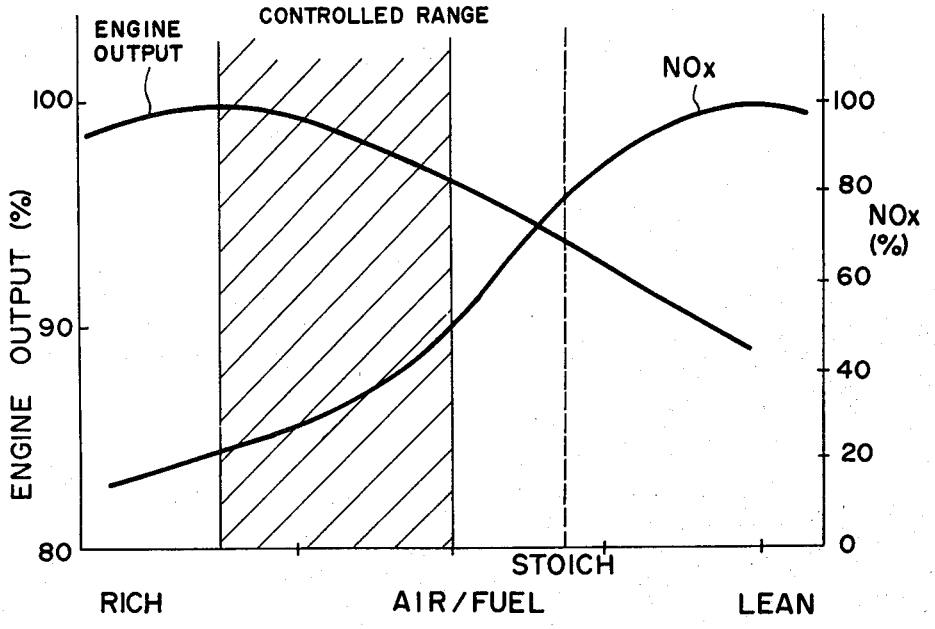
FIG. 5 shows an exemplary air-fuel ratio controlled range provided by the system of the present invention.

As can be seen in FIG. 5, an engine, supplied with a mixture having its inlet air-fuel ratio set on the rich side of stoichiometric, provides high output power and produces minimum oxides of nitrogen in its combustion chambers. Additionally, if an exhaust gas recirculation system is incorporated in such an engine in order to suppress the production of oxides of nitrogen, it is possible to recirculate a great amount of exhaust gases so as to remarkably reduce the production of oxides of nitrogen without spoiling engine performance.

Assuming then that the level shifter circuit 32 is designed such as to shift the output of the sample-hold circuit 30 down by a constant level, the operation of the air-fuel ratio control system of the present invention will be described with reference to the wave forms of FIG. 6.

Figure 6:
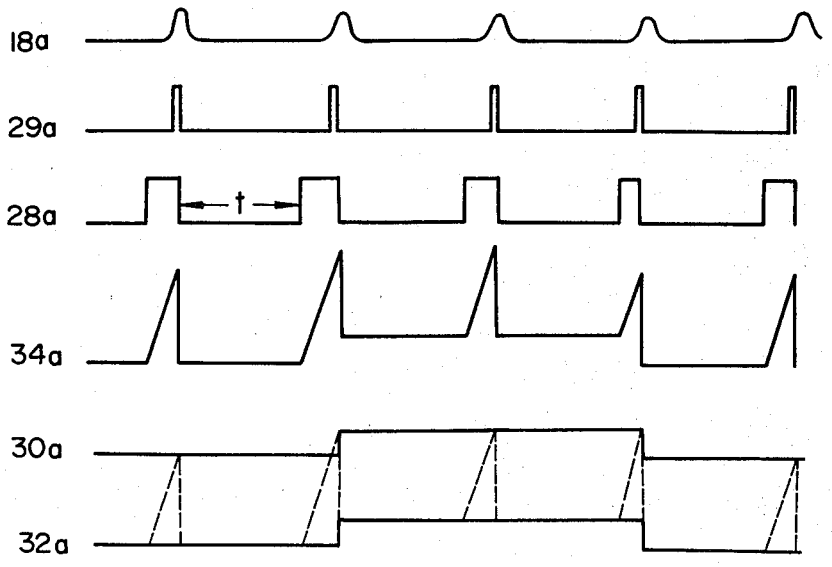
FIG. 6 shows a plurality of wave forms representing the outputs of various elements in the circuit of FIG. 2.

When the inlet air-fuel ratio shifts toward the rich side of stoichiometric and arrives at its stoichiometric level, the output of the zirconia oxygen sensor 18 becomes high as seen in wave form 18*a* of FIG. 6 to cause the trigger circuit 26 to produce a trigger pulse as seen in wave form 26*a* of FIG. 6. As a result, the sample-hold circuit 30 samples the output of the integrating circuit 34. At the same time when the output of the trigger circuit 26 becomes low, the timer circuit 28 is reset at its low level. The output of the timer circuit 28 is held low for a predetermined period of time t of, for example, several seconds, as seen in wave form 28*a* of FIG. 6, to hold the integrating circuit 34 reset during the period of time t. As a result, the output of the integrating circuit 34 is held equal to the output of the level shifter circuit 32 indicated by the wave form 32*a* of FIG. 6. The output of the integrating circuit 34 is applied as a first control signal to the pulse generator 22 which provides a drive pulse signal to the fuel injection valve 14 to control it such that the amount of fuel injected through the fuel injection valve 14 decreases to rarefy the inlet air-fuel ratio. This condition continues for the period of time t predetermined in the timer circuit 28.

When the output of the timer circuit 28 goes high automatically the predetermined time t after it is reset as seen in wave form 28*a* of FIG. 6, the integrating circuit 34 starts integrating the output of the sample-hold circuit 30 relative to the output of the level shifter circuit 32. The integrating circuit 34 ramps upward at a constant rate since the difference in level between the outputs of the sample-hold circuit 30 and the level shifter circuit 32 is constant as heretofore stated. The output of the integrating circuit 34 is applied as a second control signal to the pulse generator 22 which provides a drive pulse signal to the fuel injection valve 14 to control it such that the amount of fuel injected through the fuel injection valve 14 increases to enrich the inlet air-fuel ratio as the output of the integrating circuit 34 ramps upward. This condition continues until the inlet air-fuel ratio is rarefied to the stoichiometric level.

When the inlet air-fuel ratio is rarefied to the stoichiometric level, the output of the zirconia oxygen sensor 18 goes high and the above operation is repeated.

Figure 7:
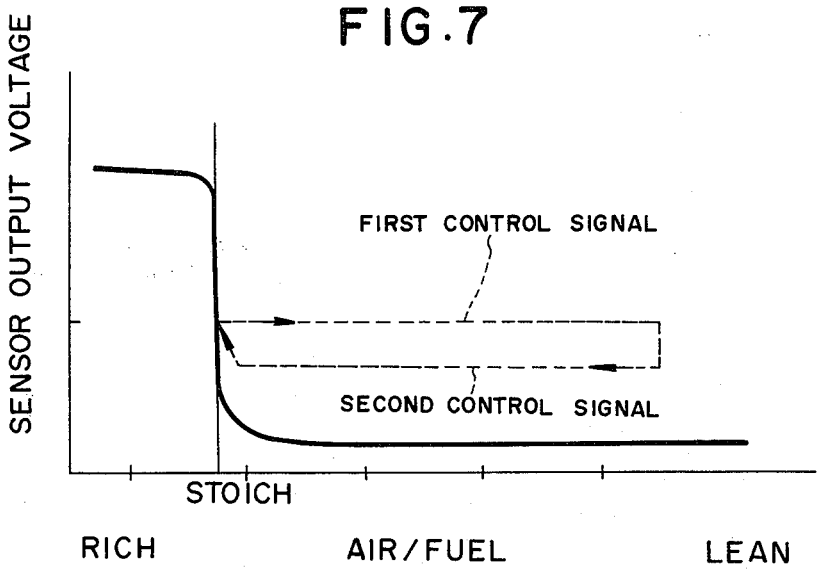
FIG. 7 shows variations in the inlet air-fuel ratio provided by the system of the present invention.

FIG. 7 illustrates variations in the inlet air-fuel ratio provided by the air-fuel ratio control system. The zirconia oxygen sensor 18 having its output sharply changed around stoichiometric air-fuel conditions is utilized as a rich side limiter for detecting the inlet air-fuel ratio enriched to its stoichiometric level. The control system controls the fuel injection valve 14 such that the amount of fuel injected therethrough decreases to rarefy the inlet air-fuel ratio for a predetermined period of time after the inlet air-fuel ratio is enriched to the stoichiometric level and then it increases to enrich the inlet air-fuel ratio until the inlet air-fuel ratio is enriched to the stoichiometric level. This operation is repeated so that the average inlet air-fuel ratio can be held at a desired level or in a desired range on the rich side of stoichiometric as shown in FIG. 8.

Figure 8:
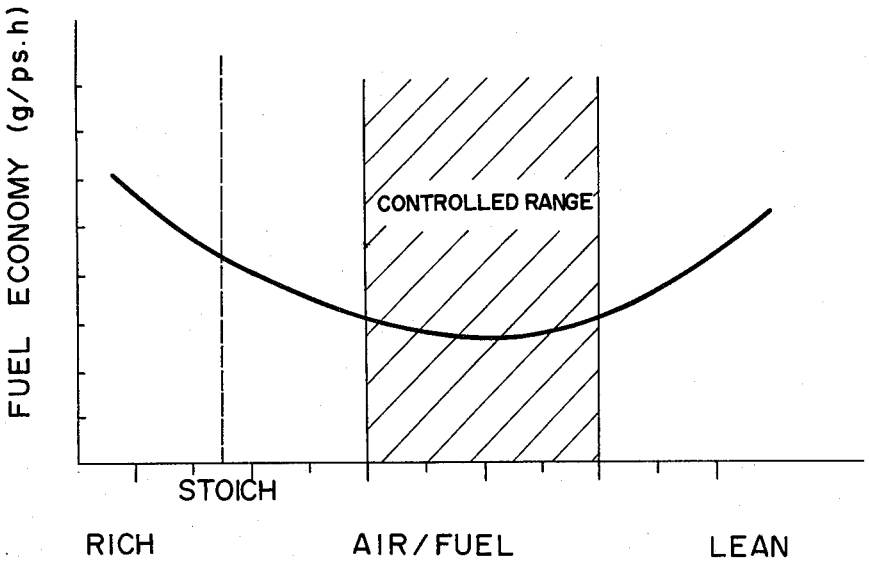
FIG. 8 shows an exemplary air-fuel ratio controlled range provided by the system of the present invention.

As can be seen in FIG. 8, an engine, supplied with a mixture having its inlet air-fuel ratio set on the lean side of stoichiometric, provides high fuel economy. In recent years, there have been made many improvements in fuel injection system, intake system, piston and combustion chamber to provide internal combustion engine operable on a very lean air-fuel mixture.

There has been provided, in accordance with the present invention, an improved air-fuel ratio control system which utilizes a conventional exhaust gas sensor having its output sharply changed around stoichiometric air-fuel conditions as a rich or lean side limiter and returns the inlet air-fuel ratio on the lean or rich side of stoichiometric when the inlet air-fuel ratio is enriched or rarefied to the stoichiometric level. The air-fuel ratio control system of the present invention provides the following advantages: First, it can control the average inlet air-fuel ratio at a desired level or in a desired range on the rich or lean side of stoichiometric which has been considered to be impossible. Second, it can provide feedback control of the amount of fuel supplied through a fuel supply system within a desired range. This eliminates the need for any highly accurate fuel supply system such as to maintain the inlet air-fuel ratio at a level and reduce the manufacturing cost of the fuel supply system. Third, it detects the inlet air-fuel ratio in accordance with the concentration of one ingredient of exhaust gases and there is no need for any device compensating for variations in fuel flow attendant on variations in temperature and pressure. Accordingly, the electronic control system is relatively simple. It is to be understood that the scope of the present invention is not to be restricted to the embodiments above described but rather, in view of the numerous modifications and changes which will readily occur to those skilled in the art, the scope of the present invention is set forth in the appended claims.

What is claimed is:

1. An air-fuel ratio control system for use in an internal combustion engine including an intake passage and exhaust passage, comprising:

(a) a sensor provided in said exhaust passage of said engine for detecting the arrival of the air-fuel ratio of a mixture supplied to said engine from said intake passage at its stoichiometric level in response to the concentration of one ingredient of exhaust gases flowing thereover;

(b) fuel supply means for supplying a controlled amount of fuel into said intake passage of said engine;

(c) control means associated with said sensor for providing first and second control signals to said fuel supply means so as to control the air-fuel ratio of said mixture, said first control signal occurring for a predetermined period of time after the air-fuel ratio arrives at the stoichiometric level to cause the air-fuel ratio to vary away from the stoichiometric level to the rich side, and said second control signal occurring with the lapse of the predetermined period of time to cause the air-fuel ratio to vary toward the stoichiometric level, thereby controlling the average air-fuel ratio on the rich side of stoichiometric, said control means comprising:

a Schmitt trigger circuit for providing a trigger pulse each time said sensor detects the arrival of the air-fuel ratio at the stoichiometric level;

a timer circuit, responsive to said trigger pulse, for providing a high output held for a predetermined period of time;

an integrating circuit;

a sample-hold circuit for sampling the output of said integrating circuit when applied with a trigger pulse from said trigger circuit and holding the output of said integrating circuit when applied with no trigger pulse;

a level shifter circuit for shifting the output of said sample-hold circuit up by a predetermined level;

said integrating circuit, responsive to a high input from said timer circuit, for integrating the output of said sample-hold circuit relative to the output of said level shifter circuit to provide said second control signal and, responsive to a low input therefrom, for passing the output of said level shifter circuit to provide said first control signal.

2. An air-fuel ratio control system according to claim 1, wherein said sensor is in the form of a zirconia oxygen sensor responsive to the concentration of the residual oxygen of exhaust gases flowing thereover for having its output changed between its on and off states around stoichiometric air-fuel conditions.

3. An air-fuel ratio control system for use in an internal combustion engine including an intake passage and exhaust passage, comprising:

(1) a sensor provided in said exhaust passage of said engine for detecting the arrival of the air-fuel ratio of a mixture supplied to said engine from said intake passage at its stoichiometric level in response to the concentration of one ingredient of exhaust gases flowing thereover;

(2) fuel supply means for supplying a controlled amount of fuel into said intake passage of said engine;

(3) control means associated with said sensor for providing first and second control signals to said fuel supply means so as to control the air fuel ratio of said mixture, said first control signal occurring for a predetermined period of time after the air-fuel ratio arrives at the stoichiometric level to cause the air-fuel ratio to vary away from the stoichiometric level to the lean side, and said second control signal occurring with the lapse of the predetermined period of time to cause the air-fuel ratio to vary toward the stoichiometric level, thereby controlling the average air-fuel ratio on the lean side of stoichiometric, said control means comprising:

a Schmitt trigger circuit for providing a trigger pulse each time said sensor detects the arrival of the air-fuel ratio at the stoichiometric level;

a timer circuit, responsive to said trigger pulse, for providing a high output held for a predetermined period of time;

an integrating circuit, a sample-hold circuit for sampling the output of said integrating circuit when applied with a trigger pulse from said trigger circuit and holding the output of said integrating circuit when applied with no trigger pulse;

a level shifter circuit for shifting the output of said sample-hold circuit down by a predetermined level; said integrating circuit, responsive to a high input from said timer circuit for integrating the output of said sample-hold circuit relative to the output of said level shifter circuit to provide said second control signal and, responsive to a low input therefrom for passing the output of said level shifter circuit to provide said first control signal.

4. An air-fuel ratio control system according to claim 3, wherein said sensor is in the form of a zirconia oxygen sensor responsive to the concentration of the residual oxygen of exhaust gases flowing thereover for having its output changed between its on and off states around stoichiometric air-fuel conditions.

* * * * *